United States Patent [19]

Speyer

[11] 4,232,411

[45] Nov. 11, 1980

[54] COMBINATION BED AND LOUNGE ASSEMBLY

[75] Inventor: Henning J. Speyer, Melrose Park, Ill.

[73] Assignee: Sears, Roebuck and Co., Chicago, Ill.

[21] Appl. No.: 42,168

[22] Filed: May 24, 1979

[51] Int. Cl.[3] ..... A47B 83/00; A47B 87/00

[52] U.S. Cl. ..... 5/8; 5/2 R; 5/9 R

[58] Field of Search ..... 5/2 R, 8, 9 R, 12, 20

[56] References Cited

U.S. PATENT DOCUMENTS

| | | | |
|---|---|---|---|
| 2,853,716 | 9/1958 | Sevcik | 5/9 R |
| 3,316,564 | 5/1967 | Rogers, Jr. | 5/9 R |
| 4,109,328 | 8/1978 | Mason | 5/2 R |

*Primary Examiner*—Casmir A. Nunberg

*Attorney, Agent, or Firm*—Arnstein, Gluck, Weitzenfeld & Minow

[57] ABSTRACT

A combination bed and lounge assembly formed of three bed units of different heights. The bed units are adapted to be arranged so as to serve as a three tiered lounge appropriate for daytime use and to be moved apart in separated relation to serve as three separate bed units appropriate for nighttime use.

4 Claims, 4 Drawing Figures

COMBINATION BED AND LOUNGE ASSEMBLY

BACKGROUND OF THE INVENTION

The present invention relates to a combination bed and lounge assembly and contemplates the use of three bed units so constructed and interrelated that the beds may serve as a three-tiered compact lounge appropriate for daytime use and may be easily and conveniently moved out in separated relation to serve as three comfortable single beds appropriate for nighttime use.

The present invention provides a system of beds particularly adapted for use in a small space, the beds being so arranged that during the daytime they provide an attractive lounge area comfortably accommodating several persons for casual sitting or reclining. For nighttime use the beds may easily be moved apart with a minimum of effort.

BRIEF DESCRIPTION OF A PREFERRED EMBODIMENT

Figure 1:
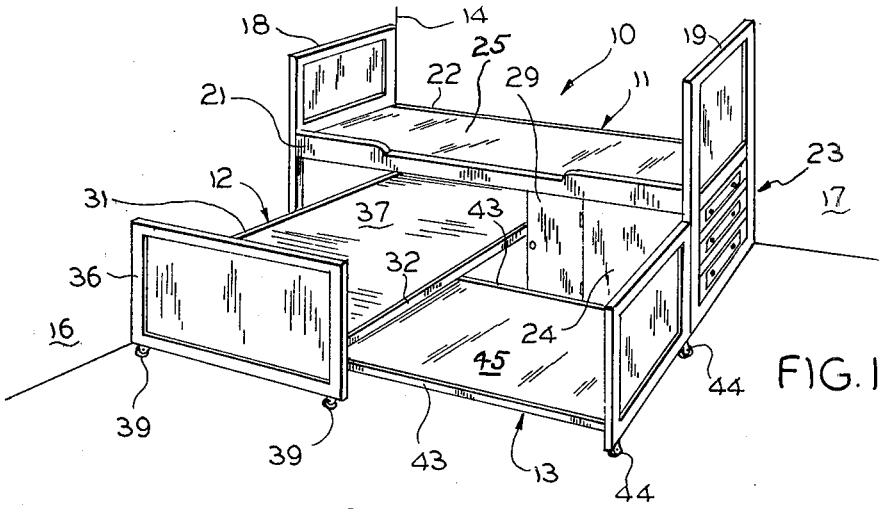
FIG. 1 is a perspective view of a combination bed and lounge assembly illustrating the bed units in a lounge mode, and without mattresses.

Referring particularly to FIG. 1, the assembly generally indicated by the numeral 10 comprises three bed units which for convenience will be hereinafter referred as first, second and third bed units 11,12 and 13, respectfully. The assembly 10, preferably but not necessarily, may be installed in a corner area 14 of a room formed by adjacent walls 16 and 17. The first bed unit 11 includes two end frame members 18 and 19, one of which may constitute a headboard, and a pair of horizontal side rails 21 and 22 supporting a panel 25 on which is carried a conventional mattress 30. The side rails 21 and 22 are secured to the end frame members 18 and 19 at a height sufficient to permit movement of a second bed unit 12 thereunder, as will be more fully hereinafter described.

In order to fully utilize the floor space available within the area under the panel 25 and remote from the wall 16, a chest of drawers, indicated generally by the numeral 23, is provided within the space adjacent the end frame member 19. The chest includes a pair of side panels 24 and a rear panel, not shown. Suitable horizontal guides, not shown, are carried on the inner surfaces of the pair of side panels 24 for supporting a plurality of tiers of drawers 26, 27 and 28. A door panel 29 is hingedly connected to an edge of the panel 24 remote from the wall 16. The first bed unit 11 may be supported on a plurality of casters. However, it is contemplated that this bed unit generally will not be moved and will remain in a stationary position.

Figure 2:
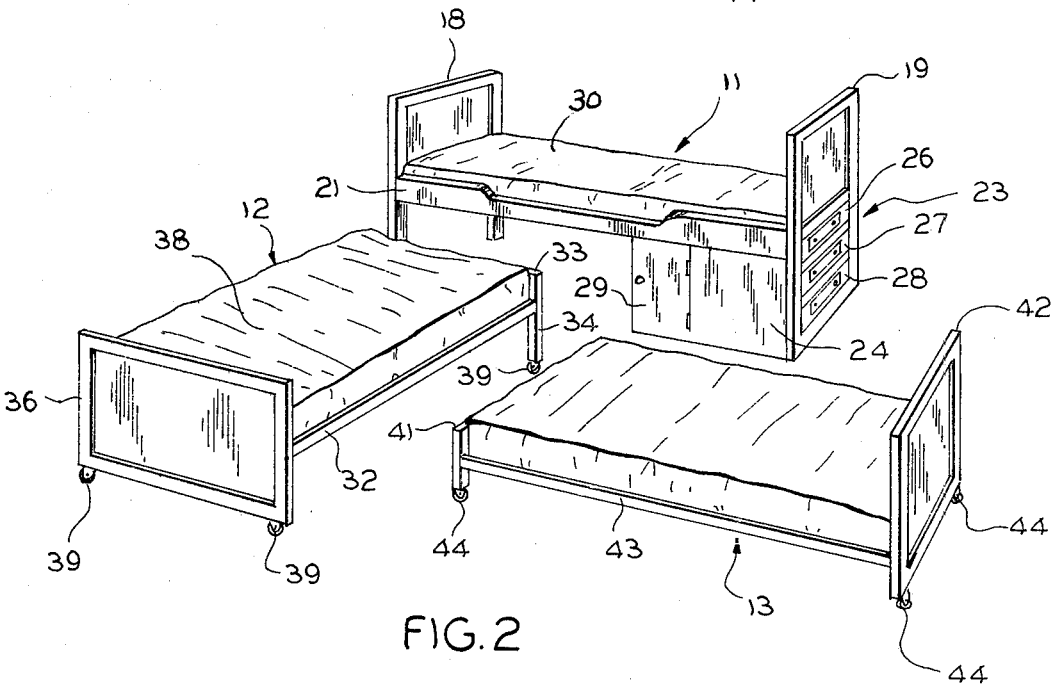
FIG. 2 is a similar view showing the bed units for sleeping purposes, and provided with mattresses.

The second bed unit 12 includes a frame having side rails 31 and 32 supported, at one end, on an end frame member 33 having a pair of supporting legs 34 and, at the other end, by a headboard 36. As in the case of the first bed unit 11, a panel 37 is supported on the frame and a conventional mattress 38 is superposed on the panel 37. It should be noted that the top surface of the mattress 38 is disposed at a height below the height of the bottoms of the rails 21 and 22 of the first bed unit, with sufficient clearance to accommodate blankets or a comforter superposed on the mattress 38 so as to permit free movement of the second bed unit 12 under the first bed unit 11. The second bed unit 12 is supported on a plurality of casters 39 mounted as shown in FIG. 2.

The construction of the third bed unit 13 is very similar to that of the second bed unit 12 and includes an end frame member 41, a headboard 42 and side rails 43 supporting a panel 45. The rails 43 are disposed at a lower elevation than the rails 32 of the second bed unit so that when provided with a mattress and blankets the end frame member 41 and adjacent portion of the bed unit will move freely under the second bed unit 12, in a manner as hereinafter will be more fully described. The third bed unit 13 is supported on a plurality of casters 44 for movement over a floor surface.

When the bed units 11, 12 and 13 are disposed in a lounge mode for daytime use, the portion of the second bed unit 12 remote from the headboard 36 is disposed in the space under the first bed unit 11 and in close proximity to the wall 17. Additionally, the third bed unit 13 is arranged in contiguous parallel relation to the first bed unit 11 with the end portion of the bed unit 13 remote from the headboard 42 disposed in the space under the second bed unit 12 and substantially contiguous to the wall 16. Thus, the three bed units 11, 12 and 13 are interengaged and occupy very little more space than the floor area of two bed units while providing three different tiers for lounging purposes.

Figure 4:
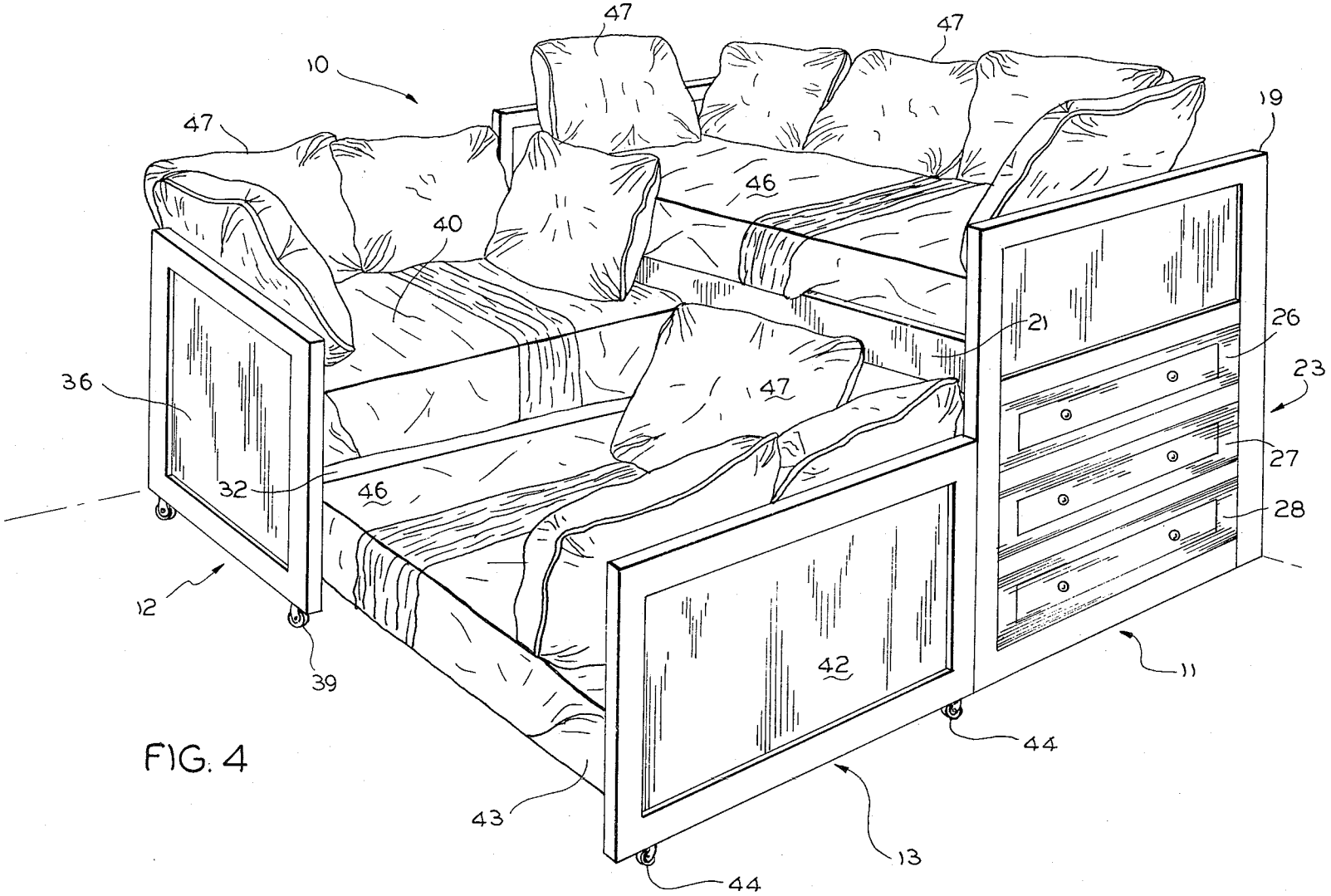
FIG. 4 is a perspective view, on an enlarged scale, similar to FIG. 1, and showing the various components of the assembly provided with mattresses and lounging pillows.

It is contemplated that in the lounging mode each of the respective bed units 11, 12 and 13 will be covered with a suitable decorative or utilitarian covering 46 and will be provided with a plurality of throw pillows or cushions 47 which may be arranged as desired. As seen in FIG. 4 three tiers of seating surfaces are provided for comfortably accommodating several persons in a casual lounging mode. The compact arrangement of the bed units in the lounging mode provides an attractive intimate grouping of seats in substantially a U-formation which accommodates a number of individuals for sitting or lounging. Each of the tiers of seating surfaces is readily accessible to a user, and one may easily step progressively from the lowermost to the highermost tier and vice versa.

For nighttime use or for sleeping purposes the bed units 11, 12 and 13 are readily separable. First the third bed unit 13 is drawn outwardly from under the second bed unit 12 to clear the same and the second bed unit 12 is then drawn outwardly from under the first bed unit 11 so that the bed units assume substantially the relationship illustrated in FIG. 2. Preferably, the second bed unit 12 is disposed in close proximately to the first bed unit so that the first bed unit 11 which is the highest, is easily accessible, even by a child, without using a ladder or stool, merely by stepping from the second bed unit to the first bed unit.

Figure 3:
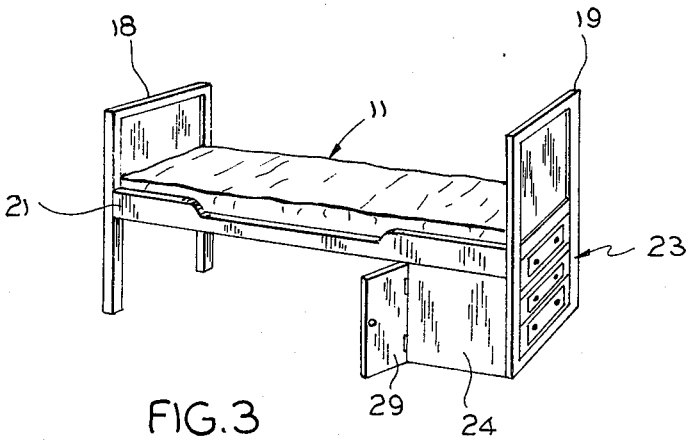
FIG. 3 is a perspective view of the primary bed unit.

A chest of drawers 23 in the first bed unit 11 provides storage facilities for toys, clothing and other articles. As seen in FIG. 1 the space immediately adjacent the chest of drawers 23 under rails 21, 22 and defined by the extent of the door panel 29, provides storage facilities for luggage, bulky boxes and other articles, it being understood that any such articles will be positioned so as not to interfere with the movement of the second bed unit 12 which occupies the space between the end frame member 18 and the free edge of the door panel 29. When the third bed unit 13 moved away from the first and second bed units 11 and 12, the door panel may be swung to open position as illustrated in FIG. 3.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. A combination bed and lounge assembly comprising first, second and third bed units, each having an occupant supporting member, the supporting member of the first bed unit being highermost, the supporting member of the second bed unit being below the supporting member of the first bed unit and the supporting member of the third bed unit being below the supporting member of the second bed unit, whereby in a lounge mode an end portion of said second bed unit is received in the space under the supporting member of said first bed unit and an end portion of said third bed unit is received in the space under the supporting member of said second bed unit which is remote from the first bed unit, with said second bed unit being disposed at a right angle to said first bed unit and the third bed unit being disposed at a right angle to said second bed unit and parallel to said first bed unit and forming a three tiered lounge assembly, said bed units being independently manually separable for sleeping purposes.

2. The invention as defined in claim 1 including roller means supporting said second and third bed units whereby said second and third bed units may be moved relative to each other and to said first bed unit.

3. The invention as defined in claim 1 including an enclosed storage space below the supporting member of the first bed unit.

4. The combination as defined in claim 1 in which the bed units when arranged as described form a three tiered lounge assembly with the bed units being manually separable for sleeping purposes.

* * * * *